United States Patent [19]

Meyer

[11] Patent Number: 4,874,395

[45] Date of Patent: Oct. 17, 1989

[54] AMINE NEUTRALIZED ALKENYLSUCCINIC ANHYDRIDE PROPYLENE GLYCOL ADDUCTS AS CORROSION INHIBITORS FOR HYDROCARBON FUELS

[75] Inventor: George R. Meyer, Missouri City, Tex.

[73] Assignee: Nalco Chemical Company, Naperville, Ill.

[21] Appl. No.: 239,801

[22] Filed: Sep. 2, 1988

[51] Int. Cl.[4] ..... C10L 1/18; C07C 101/02

[52] U.S. Cl. ..... 44/71; 252/392; 560/155; 560/156; 560/170; 560/172

[58] Field of Search ..... 44/71; 560/155, 156, 560/170, 172

[56] References Cited

U.S. PATENT DOCUMENTS

| | | | |
|---|---|---|---|
| 2,926,108 | 2/1960 | Andersen | 117/127 |
| 3,576,743 | 4/1971 | Widmer et al. | 44/71 |
| 3,687,644 | 5/1970 | Delafield et al. | 44/71 |
| 3,936,480 | 2/1976 | Demoures et al. | 44/71 |
| 3,948,800 | 4/1976 | Meinhardt | 44/71 |
| 4,195,976 | 4/1980 | Ryer et al. | 44/71 |
| 4,214,876 | 7/1980 | Garth et al. | 44/66 |
| 4,448,586 | 5/1984 | Weidig | 44/62 |
| 4,549,882 | 10/1985 | Knapp | 44/63 |
| 4,652,273 | 3/1987 | Maldonado et al. | 44/71 |
| 4,728,340 | 3/1988 | Vos | 44/71 |

OTHER PUBLICATIONS

CA106(4):20919s; L. P. Thornton; South Africa; "Inhibition of Corrosion of Metals by Alcohol-Containing Fuels".

CA104(20):171239e; T. A. Phillips; U.S.A.; "Corrosion Inhibitor for Liquid Fuels".

CA104(6):36759j; G. C. Knapp; U.S.A.; "Corrosion Inhibitors for Alcohol Containing Fuels".

*Primary Examiner*—William R. Dixon, Jr.
*Assistant Examiner*—Ellen M. McAvoy
*Attorney, Agent, or Firm*—John G. Premo; Anthony L. Cupoli; Donald G. Epple

[57] ABSTRACT

A corrosion inhibitor composition for hydrocarbon fuels comprising a $C_{10}$–$C_{24}$ alkenyl succinic anhydride esterified with between 0.5–1.5 moles of a water-soluble glycol and then neutralized with an amine.

The invention also contemplates improved hydrocarbon fuels which comprise a major portion of such fuels which contain small quantities of the above described composition.

5 Claims, No Drawings

AMINE NEUTRALIZED ALKENYLSUCCINIC ANHYDRIDE PROPYLENE GLYCOL ADDUCTS AS CORROSION INHIBITORS FOR HYDROCARBON FUELS

INTRODUCTION

Corrosion inhibitors are often added to hydrocarbon liquids in an attempt to curb or prevent rusting of the systems in which the hydrocarbons are stored, the systems in which the hydrocarbons are used, or both. Two hydrocarbons to which corrosion inhibitors are usually added are fuels and lubricating oils. Different qualities may be sought in corrosion inhibitors intended for use in lubricating oils versus corrosion inhibitors intended for use in fuels. Furthermore, concentrations will vary widely, it being likely that concentrations of inhibitors in lubricating oils will be much higher than concentrations of inhibitors in fuels.

Corrosion inhibitors used in fuels are primarily intended to prevent corrosion in storage tanks and pipelines. The corrosion problem in storage and pipeline systems usually stems from water contamination. One of the requirements demanded of corrosion inhibitors intended for use in fuel systems is that the inhibitor must be effective in very small quantities. That demand is made to avoid any adverse effects such as adding to the gun component of the fuel, etc., as well as to minimize costs. Another important requirement is that the corrosion inhibitor, in the amounts employed, must not act to emulsify water.

There is presently a need for a corrosion inhibitor for use in fuel storage tanks and pipelines where temperatures generally parallel outdoor ambient temperatures, maximum temperatures only occasionally exceeding about 100° F. (38° C.). The corrosion inhibitor should be effective at low concentrations and should not emulsify undesirable amounts of water.

Many current commercial corrosion inhibitors have been found to be very effective in inhibiting corrosion in a variety of modern fuels. Many of these materials are carboxylic acid based and are assumed to function by becoming adsorbed onto the metallic surface for which protection is desired. This adsorption results in the formation of a physical barrier which interferes with the transfer of corrosive reactants through the metal-solution interface. Such materials are referred to as filmers. Carboxylic acids have been reported to be good corrosion inhibitors in non-acidic aqueous systems, see U.S. Pat. No. 2,926,108 the disclosure of which is incorporated herein by reference, where it is likely they are acting as filmers. A typical hydrocarbon fuel additive is disclosed in U.S. Pat. No. 4,214,876, the disclosure of which is incorporated herein by reference.

It has been found in a growing number of instances that the carboxylic acid functionality has a deleterious effect in some additive package formulations. While the exact nature of these effects is difficult to determine, it appears that problems arise when the acidic corrosion inhibitor reacts with certain (proprietary) amine bases in customers' formulations to form salts which precipitate from solution to form an undesirable sludge. Thus, a non-carboxylic acid corrosion inhibitor would be desirable.

THE INVENTION

The invention comprises a corrosion inhibitor composition for hydrocarbon fuels comprising a $C_{10}$–$C_{24}$ alkenyl succinic anhydride esterified with between 0.5–1.5 moles of a water-soluble glycol and then neutralized with an amine.

The invention also contemplates an improved hydrocarbon fuel comprising a major portion of a hydrocarbon fuel and at least ½ and preferably 1–5 pounds per thousand barrels of the alkenylsuccinic anhydride composition described.

The $C_{10}$–$C_{24}$ Alkenyl Succinic Anhydride[1]

These additives are well known and are used for a variety of purposes. The most preferred for use in the practice of this invention is dodecenyl succinic anhydride.

[1] The free acid form may be used interchangeably.

The Water-Soluble Glycols

The glycols used to esterify the alkenyl substituted succinic anhydrides may be selected from such well-known glycols as ethylene glycol, propylene glycol, 1,2-butylene glycol, 1,3-butylene glycol, or lower ethylene and propylene glycols having molecular weights below about 150. The preferred glycol which is reacted with the dodecenyl succinic anhydride is propylene glycol.

The Neutralizing Amine

The aliphatic monoamines used in preparing film-forming inhibitors are those amines having the general structural formula:

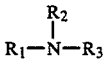

$R_1$, $R_2$ and $R_3$ are selected from the group consisting of hydrogen and an aliphatic hydrocarbon radical of 1 to 22 carbon atoms in a chain length wherein $R_1+R_2+R_3$ contains a total of at least 4 carbon atoms.

The above structural formula includes both primary and secondary aliphatic monoamines as well as the tertiary aliphatic monoamines. Illustrative compounds coming within the above general formula include such primary amines as butyl amine, hexyl amine, dibutyl amine, octyl amine, n-dodecyl amine, n-tetradecyl amine, n-hexadecylamine, lauryl amine, myristyl amine, palmityl amine, stearyl amine, and oleyl amine. Other commercially available primary amines include coconut oil amine, tallow amine, hydrogenated tallow amine and cottonseed oil amine. Useful secondary amines are dilauryl amine, dimyristyl amine, dipalmityl amine, distearyl amine, dicoconut amine and dihydrogenated tallow amine. In the case of many of the above amines, it will be noted that the source of alkyl substituent on the organic nitrogen is derived from a mixed vegetable oil or animal fat. For purposes of convenience, these compounds have been named from the derivative alkyl-containing components. This system of nomenclature, particularly in the case of alkyl substituents derived from naturally occurring products such as fats, oils and the like, is used for purposes of simplification. It is believed that those familiar with the art will readily understand that the alkyl substituent varies in the case of a coconut substituent with the alkyl groups containing from 8 to 18 carbon atoms in chain length. Similarly, in the case of hydrogenated tallow, the alkyl substituent will vary from about 12 to 20 carbon atoms in chain length.

In addition to using primary or secondary amines as exemplified above, tertiary amines such as octyl dimethyl amine, octadecyl dimethyl amine, octadecyl methyl benzyl amine, hexyldiethylamine, trilaurylamine, tricoconut amine, tricaprylyl amine, and similar type compounds also may be used.

A particularly preferred class of amines are tertiaryalkyl primary amines. The tertiary-alkyl primary amines have the formula:

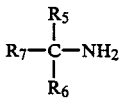

More specifically, the tertiary-alkyl primary amine constitutes a component wherein $R_5$ and $R_6$ are lower alkyl groups, usually methyl groups, and $R_7$ constitutes a long chain alkyl radical composed of 8 to 19 carbons. Tertiary-alkyl primary amines which have been found eminently suitable for the instant invention are "Primene 81-R" and "Primene JM-T". "Primene 81-R" is reported by its manufacturer to be composed of principally tertiary-alkyl primary amines having 11–14 carbons and has a molecular weight principally in the range of 171–213, a specific gravity at 25° C. of 0.813, a refractive index of 1.423 at 25° C. and a neutralization equivalent of 191. "Primene JM-T" is reported by the manufacturer to be composed of tertiary-alkyl primary amines having 18–22 carbons with a molecular weight principally in the range of 269–325, a specific gravity at 25° C. of 1,456 and a neutralization equivalent of 315.

The primary constituent of "Primene 81-R" is reported to be:

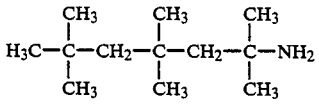

The primary constituent of "Primene JM-T" is reported to be essentially the same structure as "Primene 81-R", but with 22 carbons. "Primene" is a trademark of the Rohm & Haas Company for its brand of tertiary alkyl primary amines.

Preparation of the Esters

The esters are prepared using known organic synthetic techniques. Since the esters are not fully esterified products, it is necessary that the reaction be conducted such that the amount of glycol be within the range of 0.5 to 1.5 moles per mole of the succinic anhydride. A preferred ratio is 0.5 to 0.9 moles of the glycol.

The reaction is typically conducted utilizing an organic solvent such as a heavy naphtha. The esterification temperature and time may vary in accordance with the particular reactants used, the solvent, and the like. Preparation of a typical ester of the invention and its neutralization with an amine is set forth below in Examples 1 and 2.

EXAMPLE 1

Preparation of dodecenyl succinic anhydride-propylene glycol adducts:

A mixture of 1.2 mol of dodecenylsuccinic anhydride, 0.9 mol of propylene glycol and 40% by weight heavy aromatic naphtha was heated at 130° C. in a 1 L 3-necked, round bottomed flask equipped with a condenser and a mechanical stirrer for 6.5 hours.

EXAMPLE 2

Preparation of amine neutralized adduct:

A 500 mL round bottomed, 3-necked flask equipped with a mechanical stirrer, thermometer and condenser was charged with 201 g of dodecenylsuccinic anhydride-propylene glycol adduct (from Example 1 above) and enough heavy aromatic naphtha to make the final product 60% active. To this was added 0.4 mole of amine dropwise with stirring.

Treatment of the Hydrocarbon Fuel to Prevent Corrosion Thereof

While the compositions of the invention are particularly suited for treating any number of hydrocarbon fuels, they are particularly useful in treating gasoline and diesel fuel oils. They are normally applied in the form of a solvent solution wherein the solvent comprises from about 15–65% by weight of the composition.

Suitable solvents are normally liquid organic compounds boiling in the hydrocarbon fuel boiling range, particularly hydrocarbons and alcohols, and include hexane, cyclohexane, heptane, octane, isooctane, benezene, toluene, xylene, methanol, ethanol, propanol, butanol, gasolines, jet fuels, fuel oils and the like. Mixtures of solvents can also be used. The preferred solvent is a heavy aromatic naphtha.

The dosage of the active ingredients to prevent corrosion of the hydrocarbon fuels vary from as little as one half up to as much as 3–5 pounds per 1000 barrels of fuel.

| Evaluation of the Invention | |
|---|---|
| Composition 1 | Product of the reaction of DDSA[1] and propylene glycol (60%) |
| Composition 2 | Primene 81-R neutralized Composition 1 (60%) |
| Composition 3 | Di-N—butylamine neutralized Composition 1 (60%) |
| Composition 4 | N—Hexylamine neutralized Composition 1 (60%) |
| Composition 5 | Dodecenylsuccinic acid, 15% Dimer-Trimer acid, 45% Solvent, 40% |

[1]Dodecenylsuccinic anhydride.

The above compositions were treated using the following test method:

Spindle Rust Test

I. Test Conditions: Temperature 100°±1° F.; stirred 1,000 rpm ±50;

Time 4 hours; air contact (open)

II. Test Environment: Chromic acid cleaned beakers; 28–200 mesh silica gel depolarized iso-octane, 300 ml; 30 ml B medium hard water; integral increments lb/1,000 bbl. inhibitor; corrosion specimen new SAE 1020 hot rolled spindle.

III. Procedures:

A. Depolarization: Gravity filter 1 gal. iso-octane through 20 cm 28–200 mesh silica gel and glass wool plug in chromatographic column or 1 liter separatory funnel discarding first 50 ml.

B. Spindle preparation: Grind using vinyl gloves to avoid skin contact with 100 grit $Al_2O_3$ cloth rotating spindle at 1,700–1,800 rpm. (Use light longitudinal scratch of previous grit as indicator to assure complete removal; i.e., scratch then remove scratch with next grit.) Apply uniform cloth pressure by pulling cloth around spindle instead of pressing with fingers or thumbs.

C. Test blend preparation: Add inhibitor neat by vol to iso-octane (ratio calculated by densities) using microliter pipets, rinsing pipets thoroughly 4–5 times. Stir 5 minutes then static till up to temperature (100° F.).

D. Start-up (1) Final spindle prep; 2 slow passes with new 100 grit, wipe (firm) with lintless paper and wash with isopropanol; repeat wipe and wash, dry and insert in beaker.

(2) Soak 10 minutes without stirring, then 20 minutes with stirring.

(3) Stop stirring and add water.

(4) Start stirring and run four hours.

(5) Stop, remove spindle, wash with isopropanol, dry and examine for rust without magnification in normal indoor light (60 foot candles).

(6) Record: rust, pits, stains or deposits.

IV. Interpretation: Evaluate middle $1\frac{7}{8}''$ of spindle only.

A. Failure:

(1) Any rust soot 1 mm diameter.

(2) Six or more rust spots any size.

B. Pass rating: two tests without (1) or (2) above.

C. Stains or deposits: Examine microscopically to determine if rust. If not, still pass.

D. Rating scale:

| Rating | Proportion of Test Surface Rusted |
|---|---|
| A | None |
| B++ | Less than 0.1% (2 or 3 spots of no more than 1 mm diameter) |
| B+ | Less than 5% |
| B | 5 to 25% |
| C | 25 to 50% |
| D | 50–75% |

-continued

| Rating | Proportion of Test Surface Rusted |
|---|---|
| E | 75 to 100% |

Using the above test method, Compositions 1–5 were tested and the results are presented below:

TABLE I

| Modified Military Corrosion Test | | |
|---|---|---|
| Medium: | depolarized iso-octane | |
| Time: | 4 h | |
| Temperature: | 100° F. | |
| Aqueous phase: | synthetic seawater | |
| Percent Rust (Rating) | | |
| Composition | 2 ptb | 3 ptb |
| Composition 1 | 5 (B+) | 1 dot (B++) |
| Composition 2 | 3 (B+) | 1 dot (B++) |
| Composition 3 | 10 (B) | 0.1 (B++) |
| Composition 4 | 0.1 (B++) | 0.1 (B++) |
| Composition 5 | 7 (B) | 1 (B+) |

Having thus described my invention, I claim:

1. A corrosion inhibitor composition for hydrocarbon fuels from the group consisting of gasolines and diesel fuel oils comprising a $C_{10}$–$C_{24}$ alkenyl succinic anhydride esterified with between 0.5–1.5 moles of a water-soluble glycol and then neutralized with an aliphatic hydrocarbon amine.

2. The corrosion inhibitor composition of claim 1 which is present as a 35–85% by weight solution in an organic solvent.

3. A corrosion inhibitor composition for hydrocarbon fuels from the group consisting of gasolines and diesel fuel oils comprising a dodecenylsuccinic anhydride esterified with between 0.5–0.9 moles of propylene glycol and neutralized with an aliphatic hydrocarbon primary amine.

4. A hydrocarbon fuel selected from the group consisting of gasolines and diesel fuels comprising a major portion of the hydrocarbon fuel and at least $\frac{1}{2}$ pound per thousand barrels of the composition of claim 1.

5. A hydrocarbon fuel selected from the group consisting of gasolines and diesel fuels comprising a major portion of the hydrocarbon fuel and at least $\frac{1}{2}$ pound per thousand barrels of the composition of claim 3.

* * * * *